US005396037A

United States Patent [19]

Moore et al.

[11] Patent Number: 5,396,037

[45] Date of Patent: Mar. 7, 1995

[54] LIGHT SWITCH EXTENSION

[76] Inventors: Keith Moore, 860 Maplewood Dr., Iowa City, Iowa 52240; Luke J. LaPanne, 5855 Christie St. SE., Grand Rapids, Mich. 49508

[21] Appl. No.: 208,371

[22] Filed: Mar. 10, 1994

[51] Int. Cl.[6] ..... H01H 3/04

[52] U.S. Cl. ..... 200/331; 200/310; 200/313; 200/543

[58] Field of Search ..... 200/331, 332, 328, 330, 200/313, 310, 543

[56] References Cited

U.S. PATENT DOCUMENTS

| | | | |
|---|---|---|---|
| 2,580,905 | 1/1952 | Foster | 200/331 |
| 2,659,791 | 11/1953 | Dickinson | 200/543 |
| 2,692,932 | 10/1954 | Parke et al. | 200/331 |
| 2,719,898 | 10/1955 | Allen | 200/331 |
| 2,726,303 | 12/1955 | Berndsen | 200/331 |
| 2,954,460 | 9/1960 | Ranfield | 200/313 X |
| 3,121,778 | 2/1964 | Sander et al. | 200/331 |
| 3,142,744 | 7/1964 | Keck | 200/331 |
| 3,175,420 | 3/1965 | Craig | 200/331 X |
| 3,839,615 | 10/1974 | Bradford | 200/331 |
| 4,221,946 | 9/1980 | Halstrum | 200/331 |
| 4,590,345 | 5/1986 | Marshell | 200/331 |
| 4,620,077 | 10/1986 | Zdanys et al. | 200/331 |
| 4,743,724 | 5/1988 | Goodwin, Jr. et al. | 200/331 |
| 4,870,232 | 9/1989 | Hoogland | 200/331 |
| 5,055,645 | 10/1991 | Hull et al. | 200/331 |

*Primary Examiner*—Ernest G. Cusick

[57] ABSTRACT

An elongate support rod has a handle at one end and damp structure at its other end, with the damp structure arranged for mounting to a light switch lever, wherein the handle is arranged to provide for illumination for indication of the structure, such that a child and the like may be availed to project the structure to effect actuation of an associated light switch member.

3 Claims, 3 Drawing Sheets

LIGHT SWITCH EXTENSION

BACKGROUND OF THE INVENTION

1. Field of the Invention

The field of invention relates to extension structure, and more particularly pertains to a new light switch extension wherein the same is arranged to provide for remote actuation of a light switch.

2. Description of the Prior Art

Light switch extension structure is available in the prior art and indicated by U.S. Pat. No. 5,055,645 to permit the remote actuation of a light switch, also as indicated in U.S. Pat. No. 4,590,345 wherein a toddler may have access to the operation of a light switch. Other prior art patents include 3,839,615; 4,221,946; and 4,743,724.

The instant invention attempts to overcome deficiencies in the prior art by providing for case of retrofit of the organization relative to a light switch lever by providing cooperative clamping jaws and in this respect, the present invention substantially fulfills this need.

SUMMARY OF THE INVENTION

In view of the disadvantages inherent in the known types of light switch extension structure now present in the prior art, the present invention provides a light switch extension including cooperating facing jaws arranged to engage a light switch lever. As such, the general purpose of the present invention, which will be described subsequently in greater detail, is to provide a new light switch extension apparatus and method which has many of the advantages of the prior art listed heretofore and many novel features that result in a light switch extension apparatus which is not anticipated, rendered obvious, suggested, or even implied by any of the prior art, either alone or in any combination thereof.

To attain this, the present invention provides An elongate support rod which has a handle at one end and clamp structure at its other end, with the clamp structure arranged for mounting to a light switch lever, wherein the handle is arranged to provide for illumination for indication of the structure, such that a child and the like may be availed to project the structure to effect actuation of an associated light switch member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new light switch extension apparatus and method which has many of the advantages of the prior art listed heretofore and many novel features that result in a light switch extension apparatus which is not anticipated, rendered obvious, suggested, or even implied by any of the prior art, either alone or in any combination thereof.

It is another object of the present invention to provide a new light switch extension which may be easily and efficiently manufactured and marketed.

It is a further object of the present invention to provide a new light switch extension which is of a durable and reliable construction.

An even further object of the present invention is to provide a new light switch extension which is susceptible of a low cost of manufacture with regard to both materials and labor, and which accordingly is then susceptible of low prices of sale to the consuming public, thereby making such light switch extensions economically available to the buying public.

Still yet another object of the present invention is to provide a new light switch extension which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
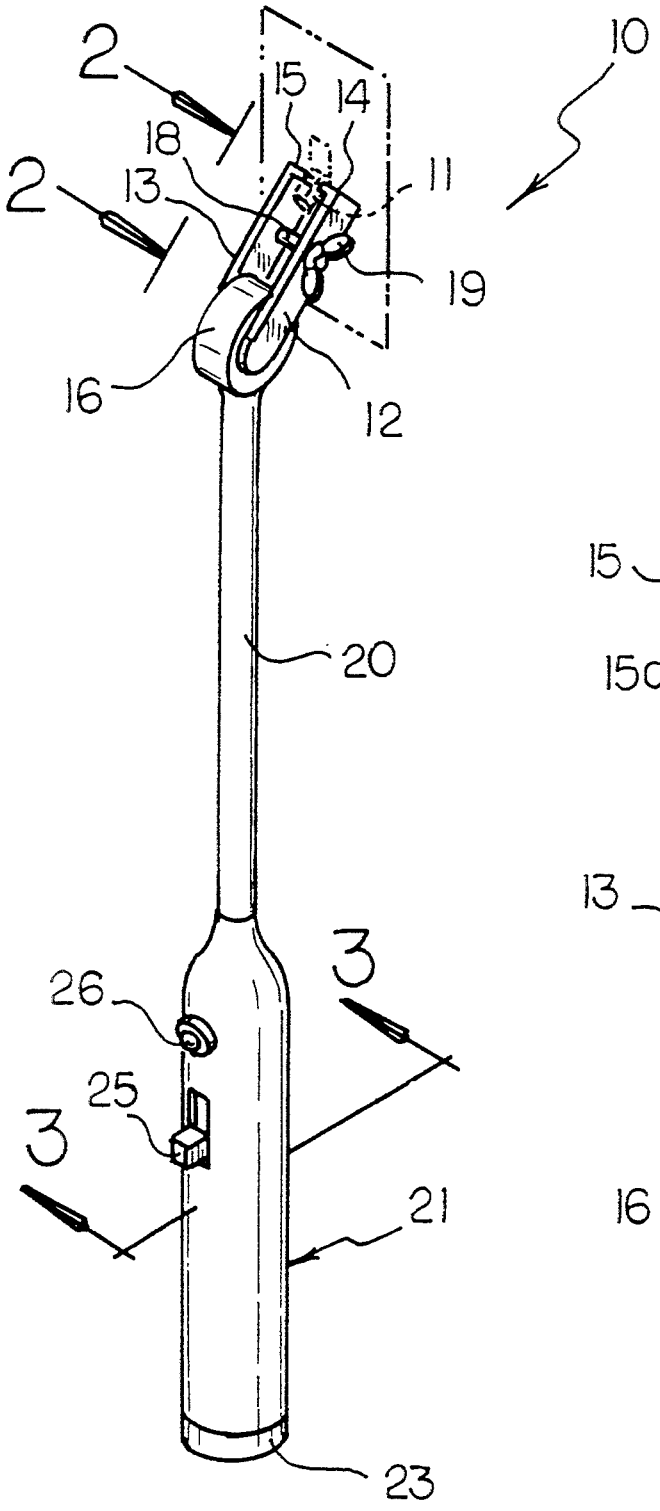
FIG. 1 is an isometric illustration of the invention.
Figure 2:
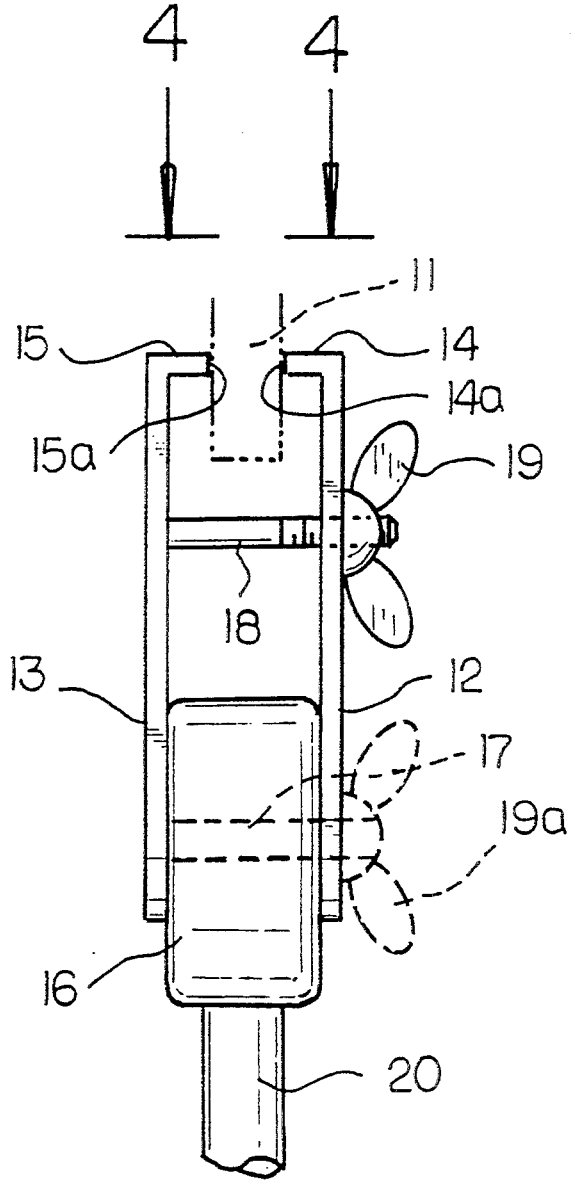
FIG. 2 is an orthographic view, taken along the lines 2—2 of FIG. 1 in the direction indicated by the arrows.

With reference now to the drawings, and in particular to FIGS. 1 to 6 thereof, a new light switch extension embodying the principles and concepts of the present invention and generally designated by the reference numeral 10 will be described.

Figure 4:
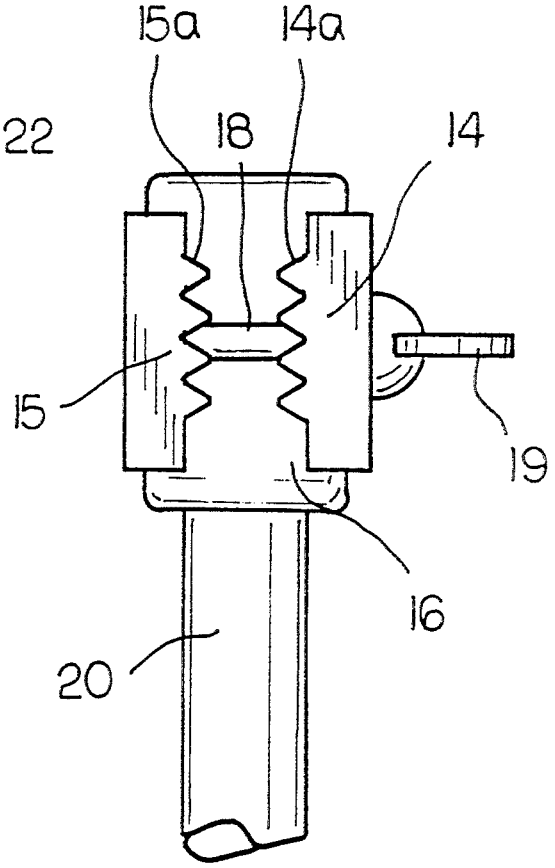
FIG. 4 is an orthographic view, taken along the lines 4—4 of FIG. 2 in the direction indicated by the arrows.

More specifically, the light switch extension 10 of the instant invention is arranged for cooperation with a wall switch lever 11, such as indicated in FIG. 1, wherein first and second jaw plates 12 and 13 of the organization are arranged in a spaced coextensive relationship relative to one another. Respective first and second jaws 14 and 15 are orthogonally and fixedly mounted at first ends of the first and second jaw plates 12 and 13 such that the first and second jaws 14 and 15 are positioned in a coplanar facing relationship, having confronting first and second jaw teeth 14*a* and 15*a*, such as indicated in FIG. 4.

The first and second jaw plates 12 and 13 have secured therebetween an axle 17 that extends through a support head 16 in a pivotal relationship. A clamp rod 18 fixedly mounted to the second jaw plate extends through the first jaw plate such that a fastener 19 engaging the clamp rod 18 exteriorly of the first jaw effects clamping of the first and second jaws 14 and 15 about the lever 11, as well as clamping the first and second plates 12 and 13 about the support head 16. The FIG. 2 indicates the optional employment of a further fastener 19*a*, such that the axle 17 is threadably directed through the further fastener 19*a* to permit the enhanced clamping of the first and second jaw plates 12 and 13 relative to the support head 16. In this manner, individuals of limited physical capacity are insured that the jaw plates 12 and 13 will remain in an operative orientation relative to the support head 16 to permit manipulation of the switch lever 11.

Figure 3:
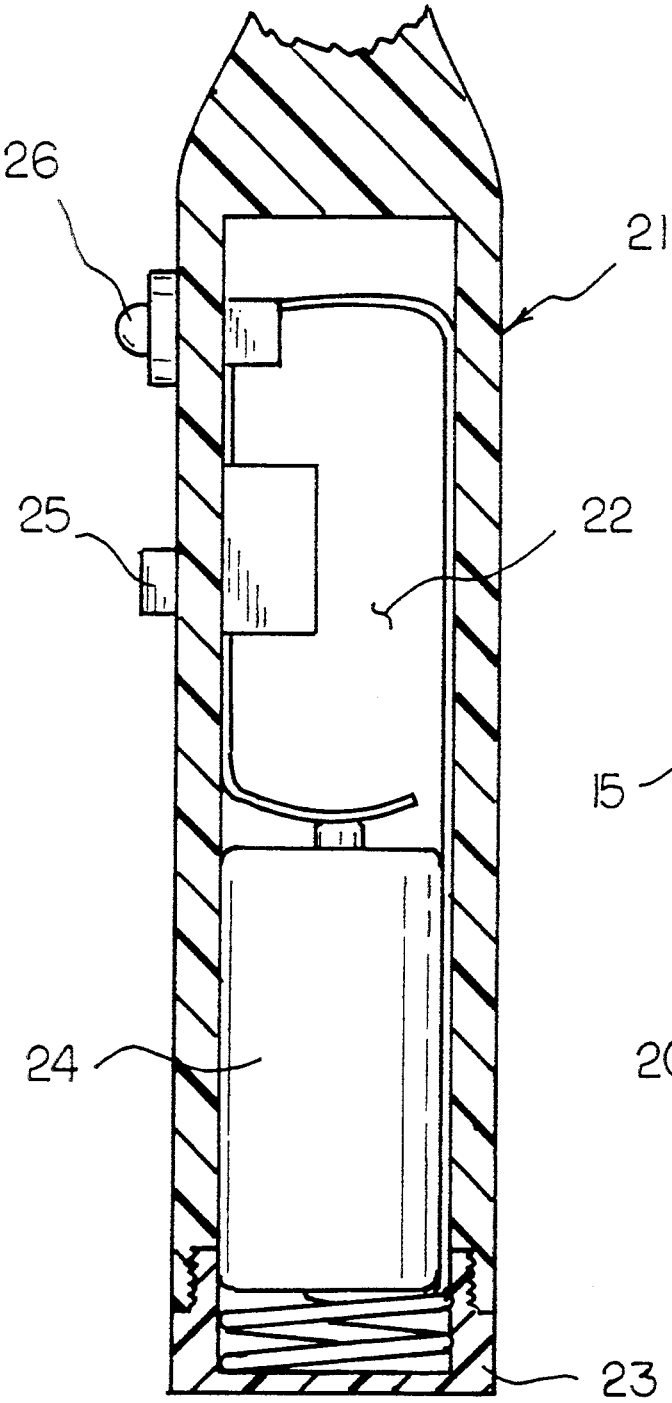
FIG. 3 is an orthographic view, taken along the lines 3—3 of FIG. 1 in the direction indicated by the arrows.

A rigid support shaft 20 is fixedly mounted to the support head 16 and extends therefrom to terminate in a handle 21. The handle 21 includes a cavity 22 positioned therewithin accessed through a handle end cap 23 threadably mounted relative to the free distal end of the handle 21 for access to a battery 24 within the cavity 22. The battery 24 is in electrical communication with an on/off switch 25 projecting through the handle 21, as illustrated in FIG. 3, and positioned in electrical communication with a signal light bulb 26 mounted to an exterior surface of the handle 21. In this manner, actuation of the signal light bulb 26 is available for indication of the structure 10 in conditions of limited available light facilitating a toddler and the like to permit ease of grasping of the handle and thereby project the support shaft 20 and the jaws 14 and 15 to effect operation and actuation of the wall switch 11.

Figure 5:
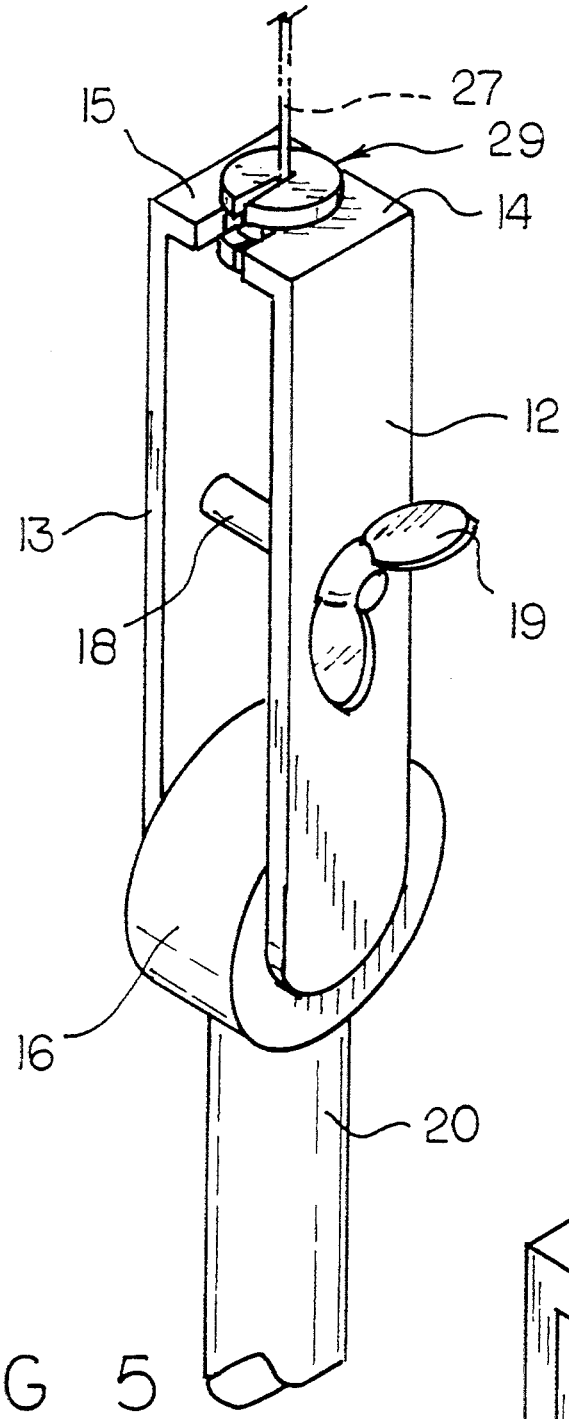
FIG. 5 is an enlarged, isometric illustration of the support head structure of the invention arranged to employ a mounting drum.
Figure 6:
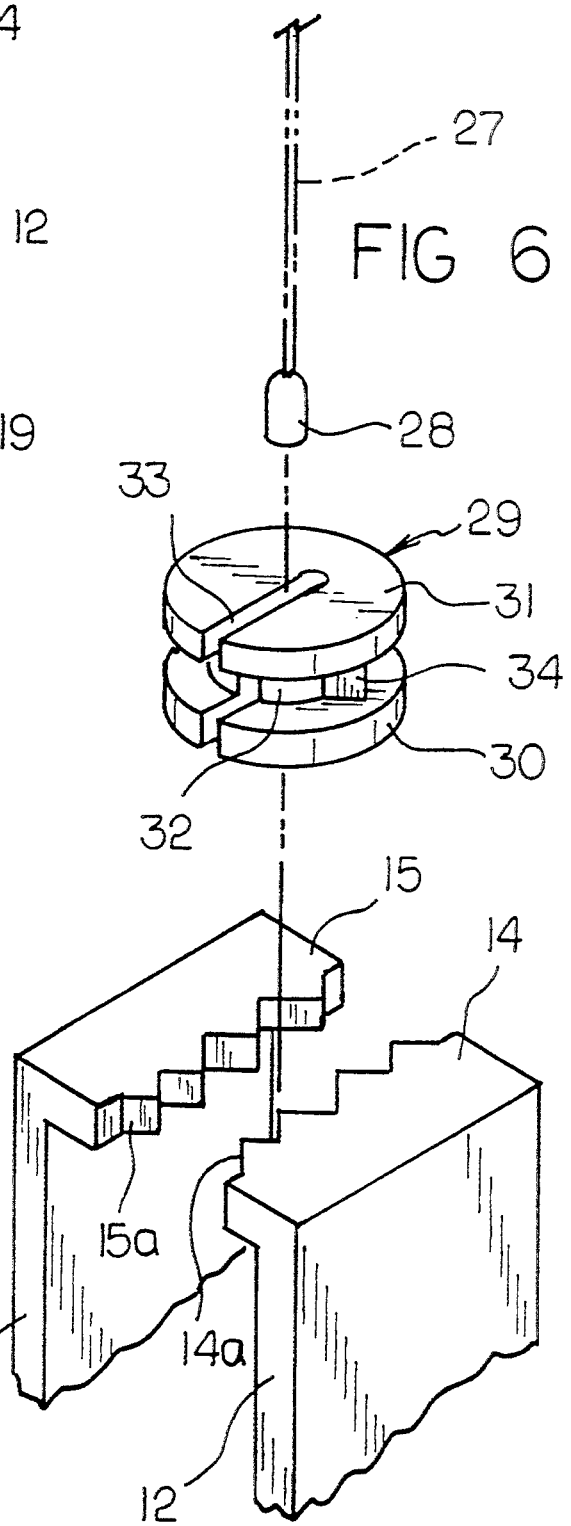
FIG. 6 is an isometric exploded view of the mounting drum arranged in cooperative relationship relative to the jaws of the instant invention.

The FIGS. 5 and 6 indicate that the first and second jaws 14 and 15 are arranged to secure therebetween a mounting drum 29 having spaced lower and upper flanges 30 and 31 secured therebetween by a central hub 32. The central hub 32, as well as the lower and upper flanges 30 and 31, includes a common slot 33 to receive a pull string 27 therethrough, such that the pull string boss 28 is oriented between the first and second jaw plates 12 and 13 permitting utilization of the structure relative to a pull light switch, instead of the wall switch lever 11. Further, the central hub 32 includes at least one central hub rib 34 projecting therefrom for reception between the first jaw teeth 14a as illustrated, but it is understood that the teeth 15*a* may also receive a like and comparably configured rib 34.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and descried in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A light switch extension comprising:

a first jaw plate and a second jaw plate, said first jaw plate being spaced from said second jaw plate in a coextensive relationship, the first jaw plate having a first jaw plate first end and the second jaw plate having a second jaw plate first end, with the first jaw plate first end defining a first jaw and the second jaw plate first end defining a second jaw, with the first jaw and the second jaw arranged in a coplanar relationship relative to one another, with the first jaw having first jaw teeth, the second jaw having second jaw teeth;

an axle extending between the first jaw plate and the second jaw plate;

a support head, the axle being received through the support head in contiguous communication with the first jaw plate and the second jaw plate, a clamp rod fixedly mounted to the second jaw plate and extending through the first jaw plate;

a fastener mounted to the clamp rod to effect projection of the first jaw plate towards the second jaw plate;

a support shaft extending from the support head and fixedly mounted to the support head, said support shaft including a handle, said handle having a handle cavity for receiving a battery, and said handle having a handle free end;

a cap member removably mounted to said handle;

electrical contact means for contacting a battery positioned within said handle cavity;

an on/off switch in electrical communication with said electrical contact means, the on/off switch projecting through said handle from said handle cavity;

and, signal means projecting through the handle for directing illumination exteriorly of the handle to indicate orientation of the handle.

2. A light switch extension as set forth in claim 1, and further including a mounting drum having a lower flange and an upper flange, a central hub positioned fixedly between the lower and upper flanges, the central hub including at least one rib arranged for reception within the first jaw teeth, with the central hub being captured between the first jaw and the second jaw; and a pull string, with the central hub, the lower flange, and the upper flange having a slot directed therethrough and operable to receive said pull string therethrough.

3. A light switch extension as set forth in claim 2, wherein the axle is externally threaded and projects through the second support plate, with a further fastener threadably receiving the axle beyond the second support plate in contiguous communication with the second support plate for enhanced securement of the first support plate and second support plate relative to the support head.

* * * * *